US009613792B2

(12) United States Patent
Harbourne et al.

(10) Patent No.: US 9,613,792 B2
(45) Date of Patent: Apr. 4, 2017

(54) MULTI-SPECTRAL ELECTRODELESS ULTRAVIOLET LIGHT SOURCE, LAMP MODULE, AND LAMP SYSTEM

(71) Applicant: Heraeus Noblelight America LLC, Gaithersburg, MD (US)

(72) Inventors: Andrew David Paul Harbourne, Potomac, MD (US); Pradyumna Kumar Swain, North Potomac, MD (US); Iginio Longo, Pisa (IT); Carlo Ferrari, Pisa (IT)

(73) Assignees: Heraeus Noblelight America LLC, Gaithersburg, MD (US); Consiglio Nazionale Delle Ricerche, Rome (IT)

( * ) Notice: Subject to any disclaimer, the term of this patent is extended or adjusted under 35 U.S.C. 154(b) by 0 days.

(21) Appl. No.: 14/208,240

(22) Filed: Mar. 13, 2014

(65) Prior Publication Data

US 2014/0265831 A1 Sep. 18, 2014

Related U.S. Application Data

(60) Provisional application No. 61/791,169, filed on Mar. 15, 2013.

(51) Int. Cl.

| | |
|---|---|
| ***H01J 7/46*** | (2006.01) |
| ***H01J 65/04*** | (2006.01) |
| ***H01J 61/86*** | (2006.01) |
| ***H01J 61/30*** | (2006.01) |
| ***H01J 61/33*** | (2006.01) |
| ***H01J 61/94*** | (2006.01) |

(52) U.S. Cl.
CPC ..... *H01J 65/042* (2013.01); *H01J 61/302* (2013.01); *H01J 61/33* (2013.01); *H01J 61/86* (2013.01); *H01J 61/94* (2013.01); *H01J 65/044* (2013.01)

(58) Field of Classification Search
CPC .. H01J 61/33; H01J 61/86; H01J 61/94; H01J 65/042; H01J 65/044
USPC ..... 315/34, 39, 248, 326
See application file for complete search history.

(56) References Cited

U.S. PATENT DOCUMENTS

| | | | | |
|---|---|---|---|---|
| 4,568,859 | A * | 2/1986 | Houkes | H01J 61/02 313/492 |
| 7,888,874 | B2 * | 2/2011 | Espiau | H01J 65/044 315/248 |
| 2005/0067976 | A1 * | 3/2005 | Longo | 315/248 |
| 2005/0128750 | A1 * | 6/2005 | Choi et al. | 362/263 |

(Continued)

*Primary Examiner* — Tung X Le
(74) *Attorney, Agent, or Firm* — Stradley Ronon Stevens & Young LLP

(57) ABSTRACT

An elongated light source envelope is disclosed. The elongated light source comprises an inner wall and an outer wall formed around a longitudinal axis. The inner wall and the outer wall may be connected at a first axial end by a first side wall and a second axial end by a second side wall. The inner wall, outer wall, the first side wall, and the second side wall define an enclosed space internal to the envelope. The light source envelope further comprises one or more walls formed between the inner wall and the outer wall to further form at least a first enclosed region and a second enclosed region within the enclosed space. The first enclosed region may be configured to emit a different spectrum of ultraviolet radiation from the second enclosed region in response to excitation of the first enclosed region and the second enclosed region by microwave radiation.

20 Claims, 11 Drawing Sheets

(56) References Cited

U.S. PATENT DOCUMENTS

| | | | | |
|---|---|---|---|---|
| 2006/0170360 | A1* | 8/2006 | Lesch | H01J 61/34<br>313/634 |
| 2012/0119119 | A1* | 5/2012 | Soltesz-Nagy | A61N 5/0614<br>250/504 R |
| 2012/0293067 | A1* | 11/2012 | Neate et al. | 315/34 |

* cited by examiner

MULTI-SPECTRAL ELECTRODELESS ULTRAVIOLET LIGHT SOURCE, LAMP MODULE, AND LAMP SYSTEM

CROSS-REFERENCE TO RELATED APPLICATIONS

This application claims the benefit of U.S. provisional patent application No. 61/791,169 filed Mar. 15, 2013, the disclosure of which is incorporated herein by reference in its entirety.

TECHNICAL FIELD

The present disclosure relates generally to ultraviolet curing lamps, and more particularly, to a microwave-powered ultraviolet (UV) light source, lamp module, and lamp system.

BACKGROUND

FIG. 1 shows a UV lamp system 10 which employs a cavity 13. The UV lamp system 10 includes a housing 15, a radio frequency (RF) or microwave wave energy source 11 (e.g., a magnetron) within the housing, and a waveguide 12 coupled to the energy source 11 within the housing 15. A space 13 remaining between the waveguide 12 and one end of the housing 15 forms a cavity 13. A UV bulb 14 is arranged in the cavity 13 of the housing 15.

The microwave energy generated by the magnetron 11 is supplied to the cavity 13 thorough the waveguide 12. Inside the cavity 13, the microwave energy is coupled to the UV bulb 14, and excites one or more elements contained in the UV lamp 14 (for example, Hg), causing the UV bulb 14 to emit ultraviolet (UV) light of a line wavelength (e.g., 365 nm). In FIG. 1, the UV bulb 14 has a 10 inch. Longer length bulb may be employed depending on the application to which the UV lamp system 10 is applied.

More recently, a new type of UV lamp that does not require a cavity has been developed. For example, U.S. Pat. No. 7,095,163 describes one example of the cavity-less UV lamp.

FIG. 2 shows a schematic view of the UV lamp 20 disclosed in U.S. Pat. No. 7,095,163. The UV lamp 20 includes a coaxial glass bulb 21 filled with Hg vapors and Ar gas. The UV lamp 20 further includes an antenna 22 inserted in a space formed by coaxial glass bulb 21 as a microwave coaxial probe. Microwave energy is supplied through the antenna 22 to excite the Hg vapor enclosed in the glass bulb 21.

In a UV lamp system comprising a plurality of electrodeless bulbs, a separate lamp may be required for each wavelength range for which UV exposure is required. In addition, because each bulb of the plurality of bulbs emits a sufficient amount of light to cure a substrate in a relatively narrow wavelength range. As a result, broadband exposure of a substrate cannot be achieved.

SUMMARY

The above-described problems are addressed and a technical solution is achieved in the art by providing an elongated light source envelope having an inner wall and an outer wall formed around a longitudinal axis. The inner wall and outer wall may be connected at a first axial end by a first side wall and a second axial end by a second side wall. The inner wall, the outer wall, the first side wall, and the second side wall may define an enclosed space internal to the envelope. The light source envelope may further comprise one or more walls formed between the outer wall and the inner wall to further form at least a first enclosed region and a second enclosed region within the enclosed space.

The above-described problems are addressed and a technical solution is achieved in the art by providing a light source module comprising an elongated light source envelope having an inner wall and an outer wall formed around a longitudinal axis. The inner wall and the outer wall may be connected at a first axial end by a first side wall and a second axial end by a second side wall. The inner wall, the outer wall, the first side wall, and the second side wall may define an enclosed space internal to the envelope. The inner wall may define an inner space around the longitudinal axis. The light source envelope may further comprise one or more walls formed between the inner wall and the outer wall to further form at least a first enclosed region and a second enclosed region within the enclosed space. The light source module may further comprise an antenna inserted in the inner space.

The above-described problems are addressed and a technical solution is achieved in the art by providing lamp system, comprising a housing, a radio frequency (RF) microwave energy source located within the housing, an antenna coupled to the RF or microwave energy source, and an elongated light source envelope radiatively coupled to the RF or microwave energy source. The elongated light source envelope may comprise an inner wall and an outer wall formed around a longitudinal axis. The inner wall and the outer wall may be connected at a first axial end by a first side wall and a second axial end by a second side wall. The inner wall, the outer wall, the first side wall, and the second side wall may define an enclosed space internal to the envelope. The inner wall may define an inner space around the longitudinal axis. The elongated light source may further comprise one or more walls formed between the inner wall and the outer wall to form at least a first enclosed region and a second enclosed region within the enclosed space. In an example, the antenna may be inserted in the inner space.

BRIEF DESCRIPTION OF THE DRAWINGS

The present disclosure will be more readily understood from the detailed description of examples presented below considered in conjunction with the attached drawings, of which.

It is to be understood that the attached drawings are for purposes of illustrating the concepts of the disclosure and may not be to scale.

DETAILED DESCRIPTION

Figure 3A:
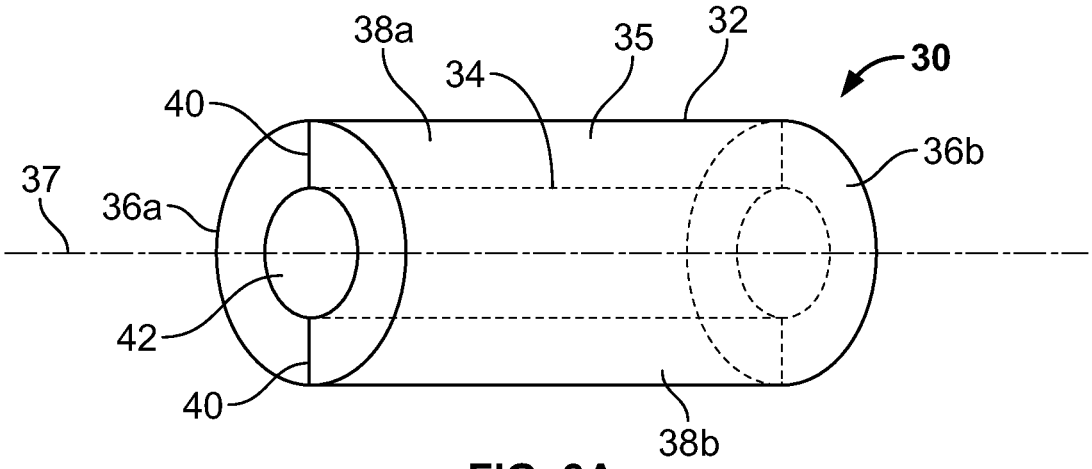
FIG. 3A shows an isometric view of an electrodeless ultraviolet light source envelope (e.g., a bulb) having two enclosed regions.
Figure 3B:
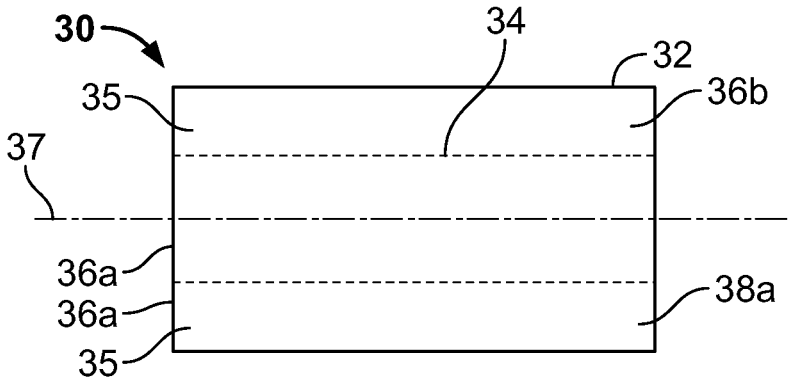
FIG. 3B is a side view of the light source envelope of FIG. 3A.
Figure 3C:
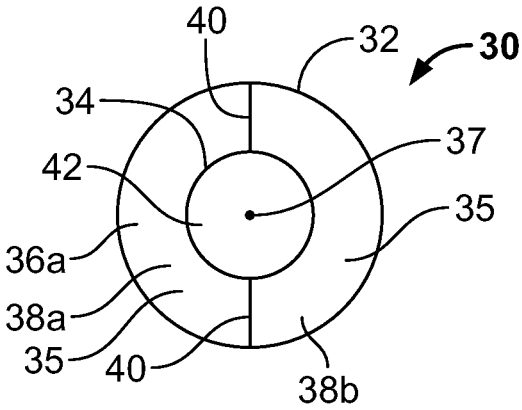
FIG. 3C is an end view of the light source envelope of FIG. 3A.

FIG. 3A shows an isometric view of an electrodeless ultraviolet light source envelope 30 (e.g., a bulb 30) having two enclosed regions 38*a*, 38*b*. FIG. 3B is a side view of the light source envelope 30 and FIG. 3C depicts an end view of the light source envelope 30. In one example, the light source envelope 30 may be tubular-shaped or have a substantially cylindrical shape illustrated in FIGS. 3A-3C.

The light source envelope 30 may comprise an outer wall 32, an inner wall 34, and side walls 36. The outer wall 32 and the inner wall 34 may be formed around a longitudinal axis 37. The outer wall 32 and the inner wall 34 may be connected at a first axial end by a first side wall 36*a* and a second axial end by a second side wall 36*b*. The outer wall 32, the inner wall 34, the first side wall 36*a*, and the second side wall 36*b* may define an enclosed space 35 internal to the light source envelope 30. The enclosed space 35 may be maintained at a reduced pressure compared to the ambient surroundings. In an example, the walls 32, 34, 36*a*, 36*b* may be made of a material that permits the transmission of a high level of ultraviolet (UV) radiation transmission, such as a glass. In one example, the glass is quartz. In another example, the walls 32, 34, 36*a*, 36*b* may be formed of sapphire. The enclosed space 35 may be further divided into a plurality of enclosed regions (e.g., 38*a*, 38*b*, forming the two enclosed regions shown in FIGS. 3A-3C) by internal walls 40. The internal walls 40 may be formed of the same material as the outer wall 32, the inner wall 34, and the side walls 36*a*, 36*b*. In an example, the side walls 36*a*, 36*b* may be formed in corresponding planes substantially perpendicular to the longitudinal axis 37.

Figure 4A:
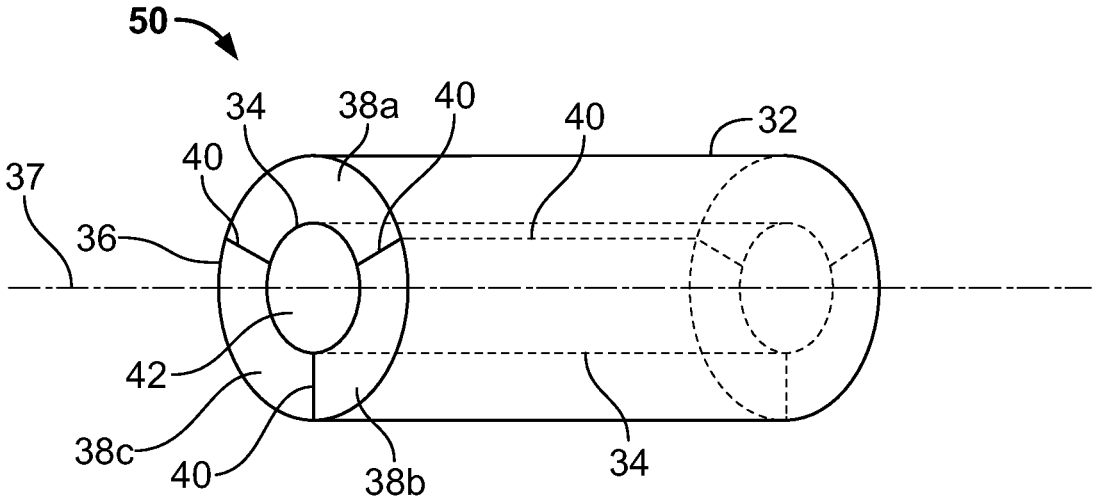
FIGS. 4A, 4B, and 4C illustrate isometric, side, and end views of an electrodeless ultraviolet light source envelope having three separate enclosed regions, respectively.
Figure 4B:
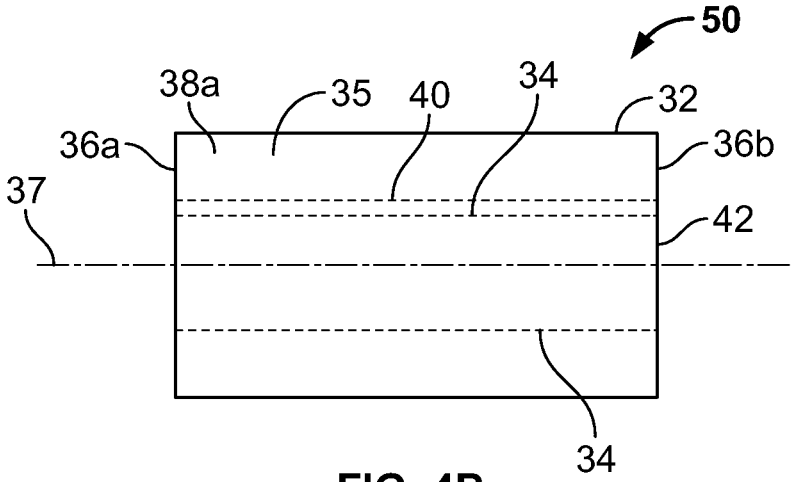
Figure 4C:
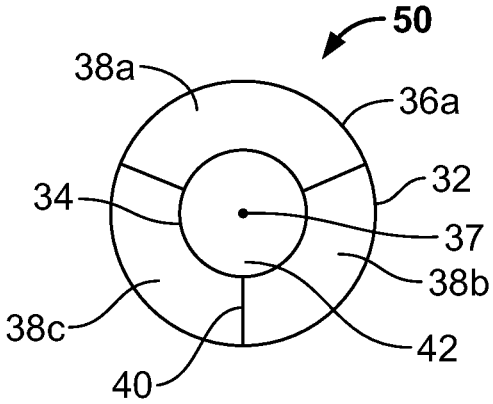
Figure 5A:
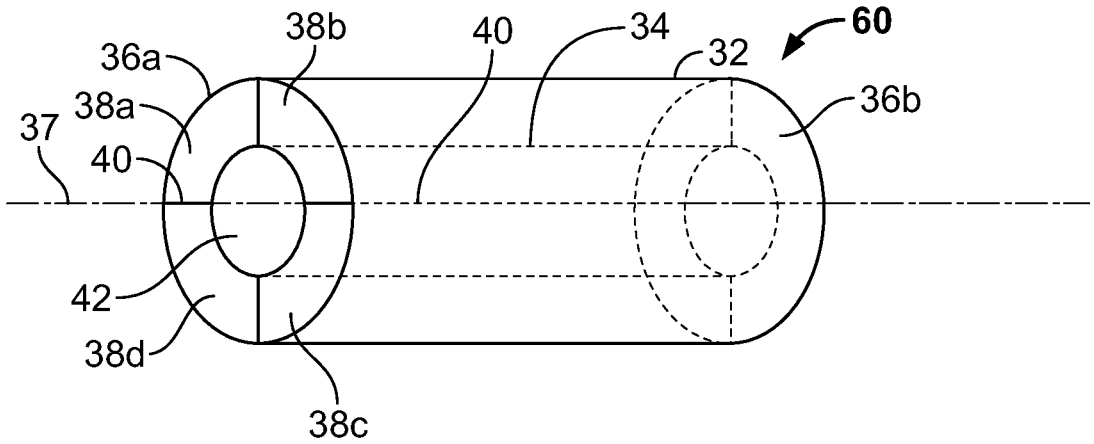
FIGS. 5A, 5B, and 5C illustrate isometric, side, and end views of an electrodeless ultraviolet light source envelope having four separate enclosed regions, respectively.
Figure 5B:
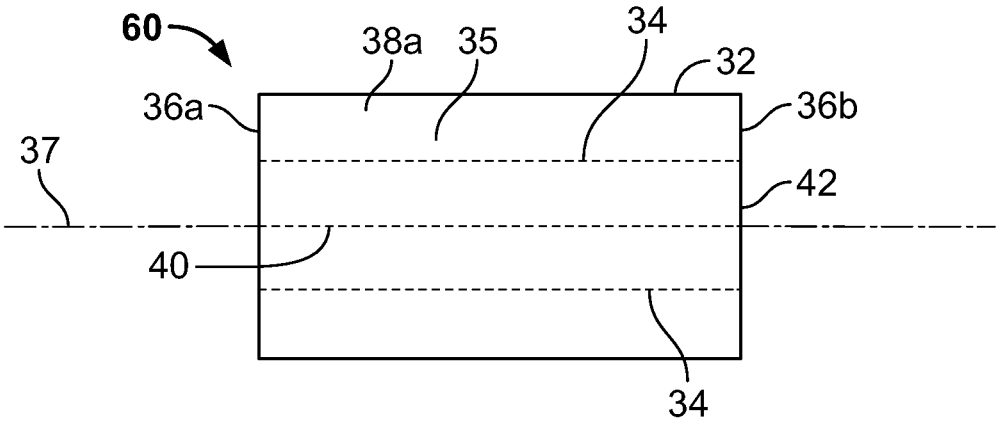
Figure 5C:
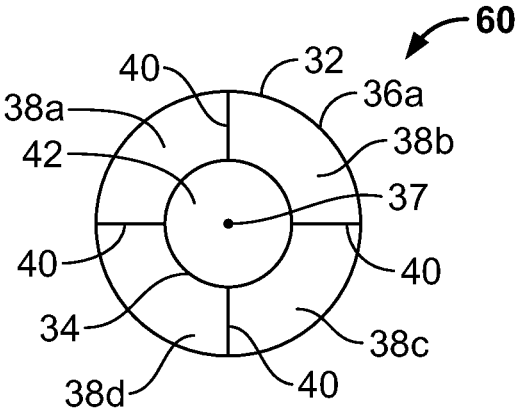

FIGS. 4A, 4B, and 4C illustrate isometric, side, and end views of an electrodeless ultraviolet light source envelope 50 having three separate enclosed regions 38*a*-38*c*. FIGS. 5A, 5B, and 5C illustrate isometric, side, and end views of an electrodeless ultraviolet light source envelope 60 having four separate enclosed regions 38*a*-38*d*.

In an example, at least one enclosed region (e.g., 38*a*) of the plurality of enclosed regions may be configured to emit a different spectrum of ultraviolet radiation from the other enclosed regions (e.g., 38*b*-38*d*) in response to, for example, excitation by microwave radiation. In another example, each of the enclosed regions 38*a*-38*d* may be configured to emit different spectrums of ultraviolet light. In an example, wavelengths of light emittable by plurality of enclosed regions 38*a*-38*d* may be adjustable. In an example, a first enclosed region (e.g., 38*a*) may be filled with a first fill material and a second enclosed region (e.g., 38*b*) may be filled with a second fill material different from the first fill material. In an example, a third enclosed region (e.g., 38*c*) may be filled with a third fill material; a fourth enclosed region (e.g., 38*d*) may be filled with a fourth filled material, etc. In an example, the wavelengths of light emittable from each enclosed region of the plurality of enclosed regions (e.g., 38*a*-38*d*) may be adjusted by varying a type of fill material or an amount of fill material in a corresponding one of the plurality of enclosed regions (e.g., 38*a*-38*d*), respectively.

In an example, the principal radiation emitting constituent of the electrodeless ultraviolet light source envelope may be mercury. Additive materials, such as metal halides, can be included in the fill glass in relatively low concentrations compared to the mercury. The mercury and additive materials, when vaporized and ionized, will emit the characteristic wavelengths of their component molecules. In addition, short wavelength photons emitted by the mercury may have sufficiently high energy so that when a photon-molecule collision occurs, an additive material will re-emit at its characteristic wavelengths. Additive emission and this "fluorescence" may be exhibited as an enrichment of the spectral output in longer UV wavelengths.

In an example, two or more of the plurality of enclosed regions 38*a*-38*d* may have different major emission peak wavelengths. In an example, the different major emission peak wavelengths may be selected from ranges comprising 170-240 nm, 250-330 nm, 340-390 nm, or 400-470 nm. As a result, the two or more enclosed regions 38*a*-38*d* may be configured to emit a broadband of light wavelengths resulting in a substantially broadband UV light being emitted from the light source envelope 30.

Figure 6:
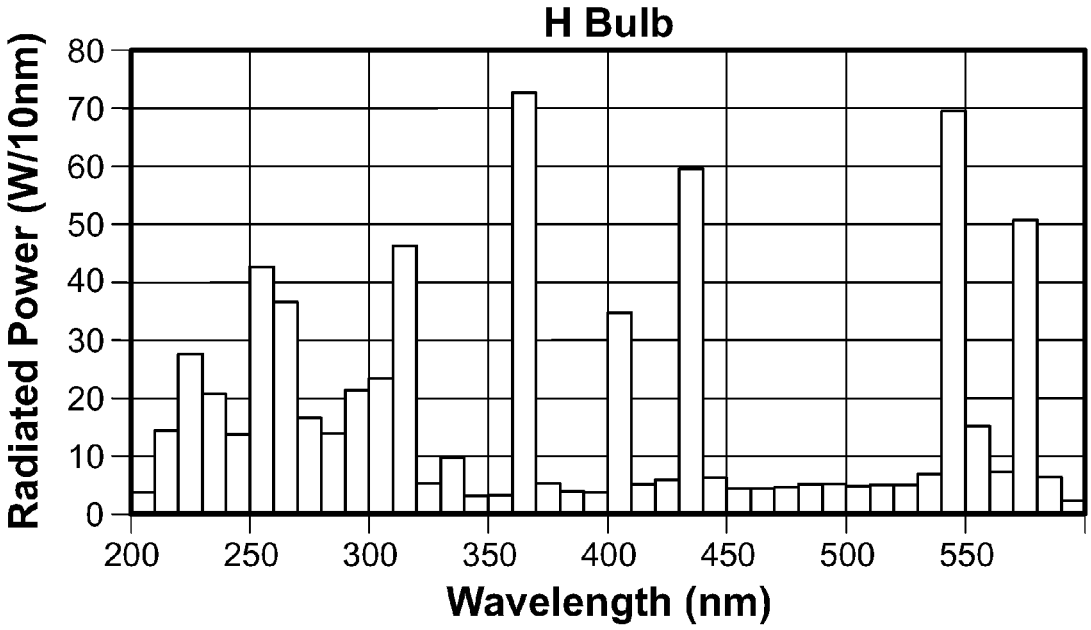
FIG. 6 illustrates the spectral output of an H bulb available from Hereaus Noblelight Fusion UV Systems, Inc. of Gaithersburg, Md., USA.
Figure 7:
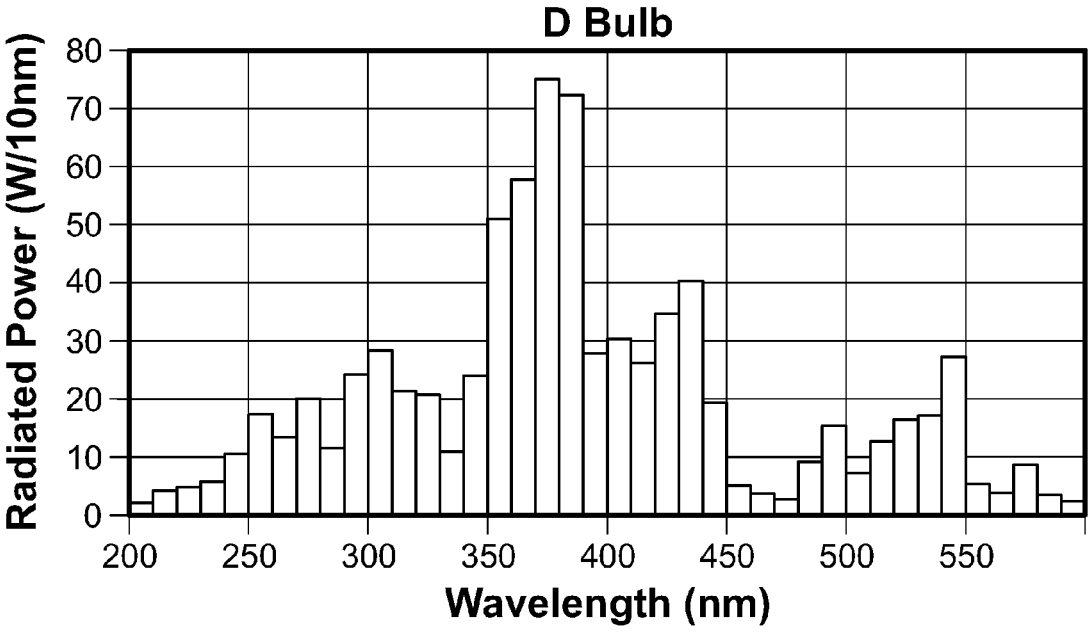
FIG. 7 illustrates the spectral output of a D bulb available from Hereaus Noblelight Fusion UV Systems, Inc.
Figure 8:
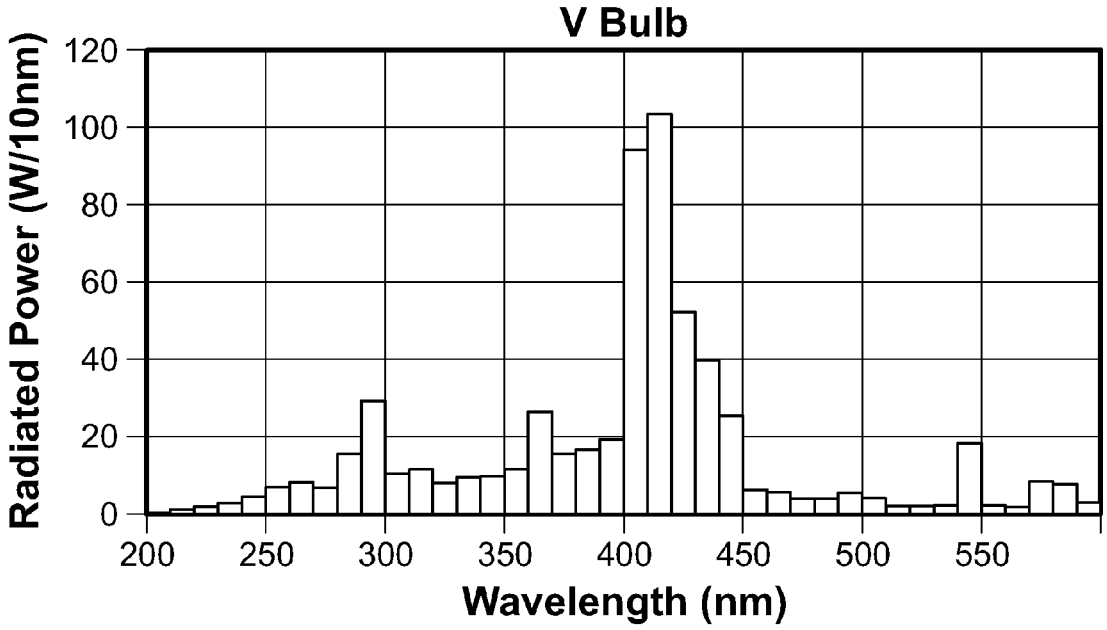
FIG. 8 illustrates the spectral output of a V bulb available from Hereaus Noblelight Fusion UV Systems, Inc.
Figure 9:
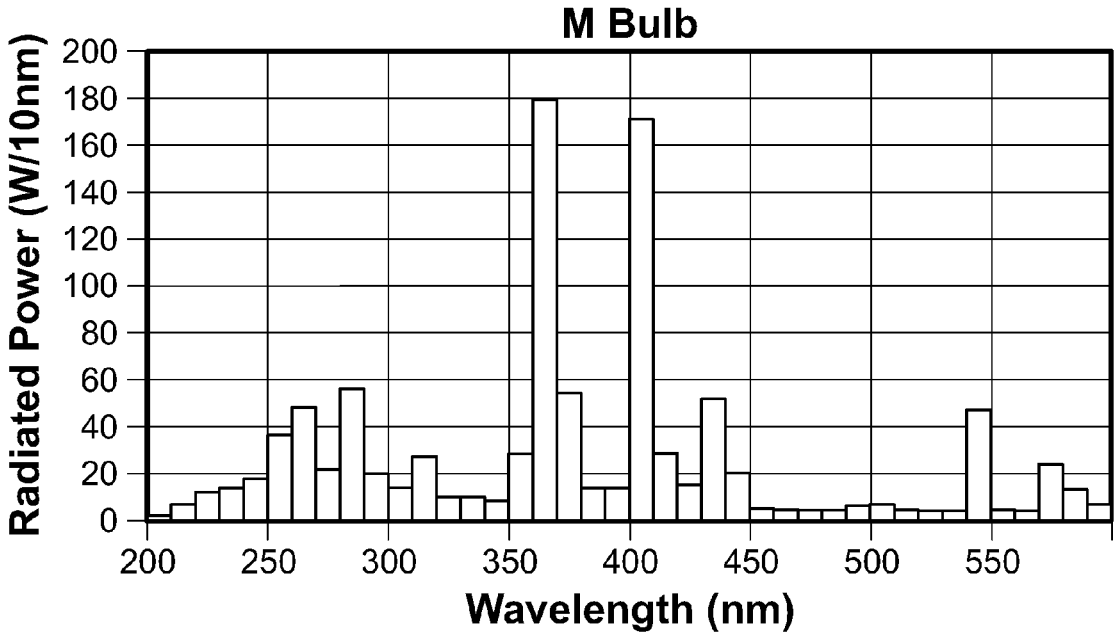
FIG. 9 illustrates the spectral output of an M bulb available from Hereaus Noblelight Fusion UV Systems, Inc.

FIGS. 6-9 show corresponding distributions of spectral power output of four different bulb fills. FIG. 6 illustrates the spectral output of an H bulb available from Hereaus Noblelight Fusion UV Systems, Inc. of Gaithersburg, Md., USA. The H bulb has a major emission region in the wavelength range of 250-330 nm. In addition, the H bulb also has major emission peaks in the 360-370 nm, 400-410 nm, 430-440 nm, and 490-530 nm wavelength ranges. FIG. 7 illustrates the spectral output of a D bulb available from Hereaus Noblelight Fusion UV Systems, Inc. The D bulb has a major emission region in the wavelength range of 340-390 nm. In addition, the D bulb also has major emission peaks in the 300-310 nm, 400-440 nm, and 510-550 nm wavelength ranges. FIG. 8 illustrates the spectral output of a V bulb available from Hereaus Noblelight Fusion UV Systems, Inc. The V bulb has a major emission region in the wavelength range of 400-440 nm. FIG. 9 illustrates the spectral output of an M bulb available from Hereaus Noblelight Fusion UV Systems, Inc. The M bulb has a pair of major emission peaks in the 360-370 nm and 400-410 nm wavelength ranges.

Differing spectral outputs of different types of bulbs can produce varying cure results in different inks and coatings. More specifically, the H bulb spectrum is effective in producing hard surface cures and high gloss finishes. The D bulb spectrum, on the other hand, because of the greater penetration of its longer wavelengths, may be more suitable for curing pigmented materials and thick sections of clear materials. The V bulb spectrum may be especially suited for curing white inks and basecoats, which typically contain high loadings of $TiO_2$.

In an example, the enclosed regions 38*a*-38*d* may emit different spectrums of ultraviolet radiation. In one example, one enclosed region 38*a* of the bulb 30 of FIGS. 3A-3C may emit the H bulb spectrum, while the other enclosed region 38*b* may emit the D bulb, V bulb, or M bulb spectrum. In the bulb 50 of FIGS. 4A-4C having three enclosed regions 38*a*-38*c*, one enclosed region 38*a* may emit the H bulb spectrum, a second enclosed region 38*b* may emit a D bulb spectrum, and a third enclosed region 38*c* may emit the V bulb spectrum. The four region bulb 60 of FIGS. 5A-5C may include enclosed regions 38*a*-38*d* configured to emit one each of the H, D, V, and M bulb spectrums. In an example, each of the bulbs 30, 50, 60 may be configured to emit any combination of different and/or the same spectral ranges. In an example, a bulb (e.g., a UV-emitting, electrodeless, light source envelope) may be configured to have any number of enclosed regions configured to emit any combination of different and/or the same spectral ranges.

In an example, the bulbs 30, 50, 60 may perform a variety of different functions, such as providing a high gloss surface cure and a deep cure at the same time. Other applications may include the curing a plurality of different materials, each of which is sensitive to a respective different wavelength(s) emitted by the different enclosed regions 38*a*-38*d*.

Figure 1:
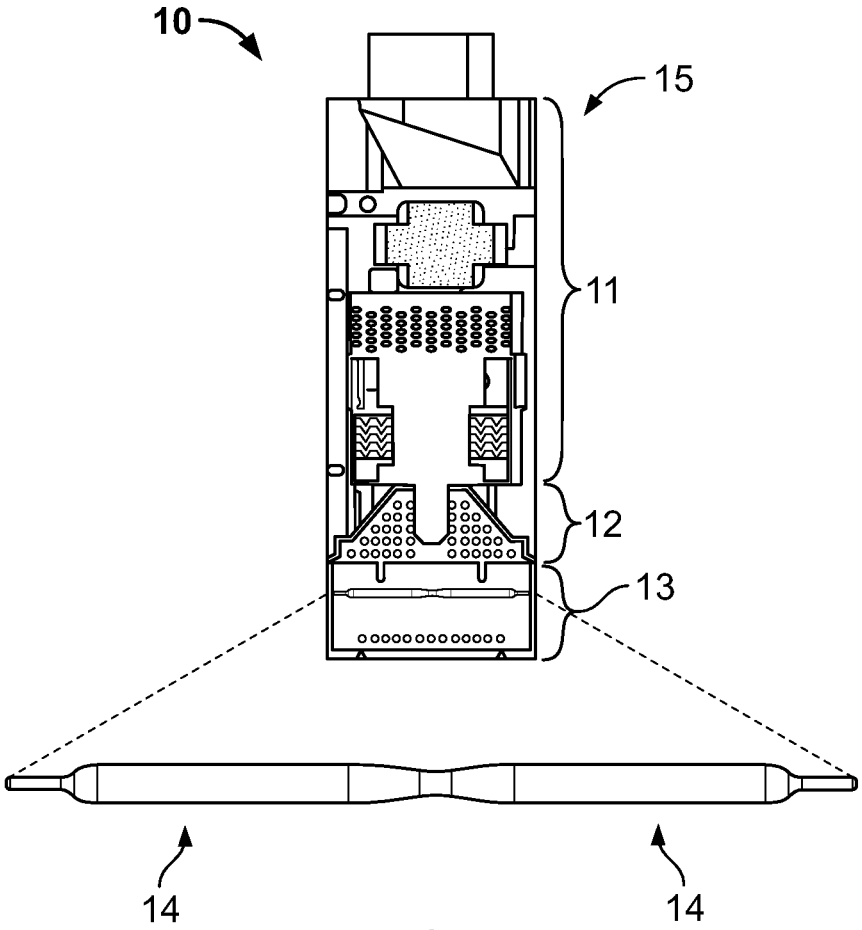
FIG. 1 (Prior Art)
FIG. 1 shows a UV lamp system which employs a cavity.
Figure 2:
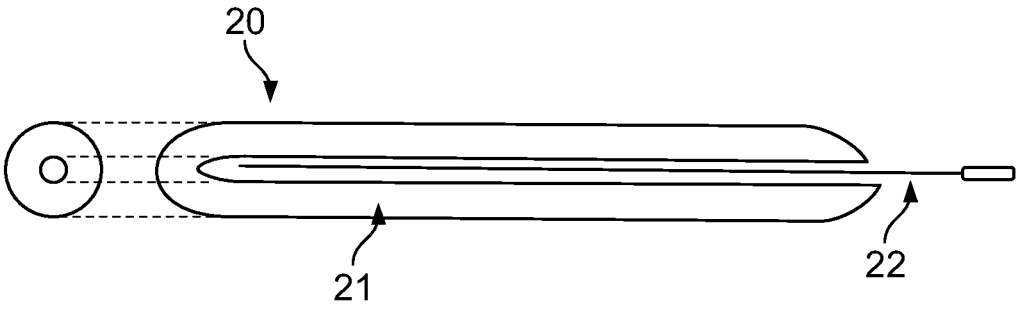
FIG. 2 (Prior Art)
FIG. 2 shows a schematic view of the UV lamp disclosed in U.S. Pat. No. 7,095,163.
Figure 10:
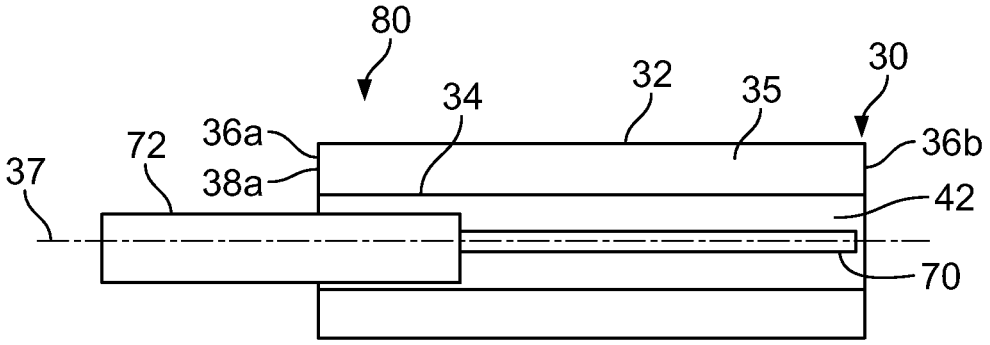
FIG. 10 shows a cavity-less ultraviolet lamp module comprising the light source envelope of FIGS. 3A-3C and an antenna for radiating microwave energy.

FIG. 10 shows a cavity-less ultraviolet lamp module 80 comprising the light source envelope 30 and an antenna 70 for radiating microwave energy. In an example, the cavity-less ultraviolet lamp module 80 may comprises an elongated light source envelope 30 having an outer wall 32 and an inner wall 34 formed around a longitudinal axis 37. The outer wall 32 and the inner wall 34 may be connected at a first axial end by a first side wall 36*a* and a second axial end by a second side wall 36*b*. The outer wall 32, the inner wall 34, the first side wall 36*a*, and the second side wall 36*b* may define an enclosed space 35 internal to the light source envelope 30. The inner wall 34 may define an inner space 42 around the longitudinal axis 37. In an example, the walls 32, 34, 36*a*, 36*b* may be made of a material that permits the transmission of a high level of ultraviolet (UV) radiation transmission, such as a glass. In one example, the glass is quartz. In another example, the walls 32, 34, 36*a*, 36*b* may be formed of sapphire. The enclosed space 35 may be further divided into a plurality of enclosed regions (e.g., 38*a*, 38*b*, forming the two enclosed regions shown in FIGS. 2A-2C) by internal walls 40. The internal walls 40 may be formed of the same material as the outer wall 32, the inner wall 34, and the side walls 36*a*, 36*b*. In an example, the side walls 36*a*, 36*b* may be formed in corresponding planes substantially perpendicular to the longitudinal axis 37.

The light source module 80 may further comprise an antenna 70 inserted in the inner space 42 (e.g., an opening) around the longitudinal axis 37. The first enclosed region 38*a* may be configured to emit a different spectrum of ultraviolet radiation from the second enclosed region (not shown) in response to excitation by microwave radiation.

In an example, the antenna 70 may comprise an antenna lead. In an example, the antenna lead may be an exposed inner conductor of a coaxial cable 72. The coaxial cable 72 may comprise the inner conductor, an insulator, and an outer conductor. The insulator may be made of a heat resistant material resistant to heat emitted by the lamp module 80. The heat resistant material may be, for example, a ceramic.

In an example, the antenna lead may be inserted into the inner space 42 from first open end 44 proximal to the inner space 42 around the longitudinal axis 37, and heat generated by the antenna 72 and the light source envelope 30 while the lamp module 80 is operated may be conducted through the second open end 46.

In an example, the coaxial cable 72 may be configured to be connected to a radio frequency (RF) or microwave energy source. The RF or microwave energy source (not shown) may be a magnetron.

In an example, the side walls 36*a*, 36*b* may be formed in corresponding planes substantially perpendicular to the longitudinal axis 37. The light source envelope 30 may have substantially cylindrical shape. In an example, the light source envelope 30 may be electrodeless. In an example, the light source envelope 30 may have additional enclosed regions separated from the first enclosed region 38*a* and second enclosed region 38*b* (not shown) by additional internal walls 40.

In an example, the first enclosed region 38*a* may be filled with a first fill material and the second enclosed region 38*b* may be filled with a second fill material different from the first fill material. In an example, the wavelengths of light emittable by the first enclosed region 38*a* and the second enclosed region 38*b* are adjustable. The wavelengths of light emittable by the first enclosed region 38*a* and the second enclosed region 38*b* may be adjusted by varying a type of fill material or an amount of fill material in the first enclosed region 38*a* and the second enclosed region 38*b*, respectively.

In an example, the first enclosed region 38*a* and the second enclosed region 38*b* may have different major emission peak wavelengths. The different major emission peak wavelengths may be selected from ranges comprising 170-240 nm, 250-330 nm, 340-390 nm, or 400-470 nm. The first enclosed region 38*a* and the second enclosed region 38*b* may be configured to emit a broadband of light wavelengths resulting in a substantially broadband UV light being emitted from the light source envelope 30.

In an example, the light source module 80 may further comprise a reflector (not shown) located around the outer wall of the light source envelope.

Figure 11:
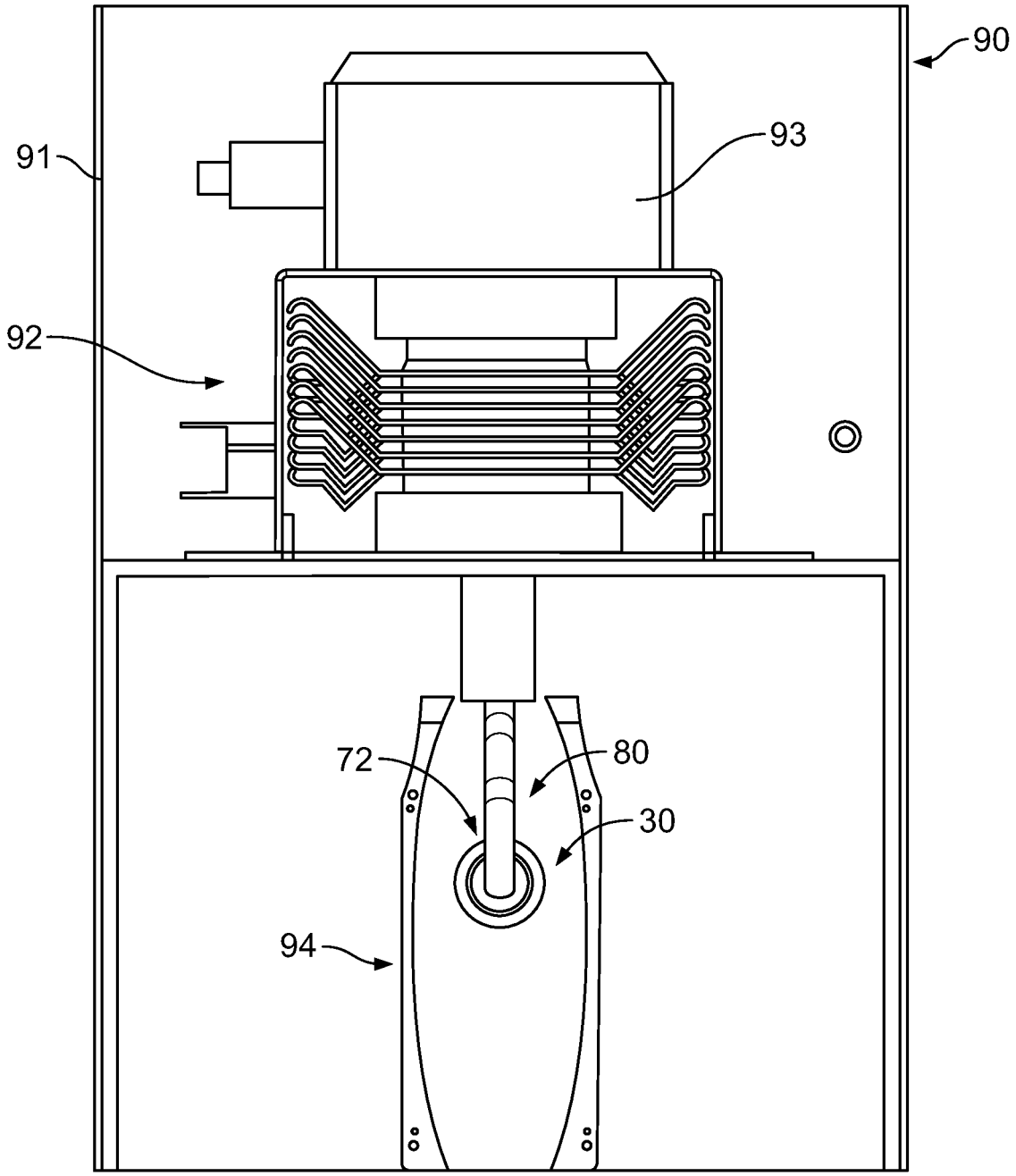
FIG. 11 shows a cavity-less UV lamp system comprising, for example, the UV lamp module of FIG. 10, the latter comprising one of the electrodeless ultraviolet light source envelopes of FIGS. 3A-5C.

FIG. 11 shows a cavity-less UV lamp system 90 comprising, for example, the UV lamp module 80 of FIG. 10, the latter comprising one of the electrodeless ultraviolet light source envelopes 30, 40, 50 of FIGS. 3A-5C. In an example, the cavity-less UV lamp system 90 may comprise a housing 91, a high voltage power supply 93 located within the housing 91, a radio frequency (RF) or microwave energy source 92 located within the housing 91 and coupled to the high voltage power supply 93, an antenna (not shown) coupled to the RF or microwave energy source 92, and the UV lamp module 80 comprising the elongated light source envelope (e.g., 30, 40, 50) radiatively coupled to the RF or microwave energy source 92. The RF or microwave energy source 92 may be, for example, a magnetron. A coaxial cable 72 supplies microwave energy from the RF or microwave energy source 92. In one example, the cavity-less UV lamp system 90 includes a reflector 94 to focus the bulb energy on to a substrate (not shown).

More particularly, the elongated light source envelope (e.g., 30, 40, 50) may comprise an inner wall 34 and an outer wall 32 formed around a longitudinal axis 37. The inner wall 34 and the outer wall 32 may be connected at a first axial end by a first side wall 36*a* and a second axial end by a second side wall 36*b*. The inner wall 34, the outer wall 32, the first side wall 36*a*, and the second side wall 36*b* may define an enclosed space 35 internal to the envelope (e.g., 30, 40, 50). The inner wall 34 may define an inner space 42 around the longitudinal axis 37. The elongated light source envelope (e.g., 30, 40, 50) may further comprise one or more walls 40 formed between the inner wall 34 and the outer wall 32 to form at least a first enclosed region 38*a* and a second enclosed region 38*b* within the enclosed space 35. In an example, the antenna 70 may be inserted in the inner space 42.

In an example, the antenna 70 may comprise an antenna lead having a first end proximal to the inner space 42 around the longitudinal axis 37 and a second end configured to be connected to a radio frequency (RF) or microwave energy source 92 (e.g., a magnetron). In an example, the antenna lead may be an exposed inner conductor of a coaxial cable 72. The coaxial cable 72 may comprise the inner conductor, an insulator, and an outer conductor. The insulator may be made of a heat resistant material resistant to heat emitted by the lamp module. The heat resistant material may be, for example, a ceramic.

In an example, the first side wall 36*a* and the second side wall 36*b* may be formed in corresponding planes substantially perpendicular to the longitudinal axis 37. The light source envelope (e.g., 30, 40, 50) may have a substantially cylindrical shape. In an example, the light source envelope (e.g., 30, 40, 50) may be electrodeless. In an example, the light source envelope (e.g., 30, 40, 50) may have additional enclosed regions separated from the first enclosed region and second enclosed region by additional internal walls 40.

In an example, the light source envelope (e.g., 30, 40, 50) may have a first open end 44 and a second open end 46 enclosing the inner space 42. The antenna lead may be inserted into inner space 42 from the first open end 44, and heat generated by the antenna 70 and the light source envelope (e.g., 30, 40, 50) while the UV lamp module 80 is operated may be conducted through the second open end 46.

In an example, the first enclosed region 38*a* may be filled with a first fill material and the second enclosed region 38*b* may be filled with a second fill material different from the first fill material. In an example, the wavelengths of light emittable by the first enclosed region 38*a* and the second enclosed region 38*b* may be adjustable. The wavelengths of light emittable by the first enclosed region 38*a* and the second enclosed region 38*b* may be adjusted by varying a type of fill material or an amount of fill material in the first enclosed region and the second enclosed region, respectively.

In an example, the first enclosed region 38*a* and the second enclosed region 38*b* may have different major emission peak wavelengths. The different major emission peak wavelengths may be selected from ranges comprising 170-240 nm, 250-330 nm, 340-390 nm, or 400-470 nm. The first enclosed region 38*a* and the second enclosed region 38*b* may be configured to emit a broadband of light wavelengths resulting in a substantially broadband UV light being emitted from the light source envelope.

In an example, the UV light source module 80 may further comprise a reflector 94 located around the outer wall 32 of the light source envelope (e.g., 30, 40, 50).

It is to be understood that the above description is intended to be illustrative, and not restrictive. Many other embodiments will be apparent to those of skill in the art upon reading and understanding the above description. Although the present disclosure has been described with reference to specific exemplary embodiments, it will be recognized that the disclosure is not limited to the embodiments described, but can be practiced with modification and alteration within the spirit and scope of the appended claims. Accordingly, the specification and drawings are to be regarded in an illustrative sense rather than a restrictive sense. The scope of the disclosure should, therefore, be determined with reference to the appended claims, along with the full scope of equivalents to which such claims are entitled.

What is claimed is:

1. An elongated light source envelope, comprising:

an inner wall and an outer wall formed around a longitudinal axis, the inner wall and the outer wall connected at a first axial end by a first side wall and a second axial end by a second side wall, the inner wall, the outer wall, the first side wall, and the second side wall defining an enclosed space internal to the envelope; and one or more walls included between the inner wall and the outer wall to form at least a first enclosed region and a second enclosed region within the enclosed space, wherein the one or more walls extending along the longitudinal axis from the first side wall to the second side wall, and wherein the inner wall defines an inner space of the elongated light source envelope configured to receive an antenna.

2. The light source envelope of claim 1, wherein the first enclosed region is configured to emit a different spectrum of ultraviolet radiation from the second enclosed region in response to excitation of the first enclosed region and the second enclosed region by microwave radiation.

3. The light source envelope of claim 1, wherein the first enclosed region is filled with a first fill material and the second enclosed region is filled with a second fill material different from the first fill material.

4. The light source envelope of claim 3, wherein the wavelengths of light emittable from the first enclosed region and the second enclosed region are adjusted by varying a type of fill material or an amount of fill material in the first enclosed region and the second enclosed region, respectively.

5. The light source envelope of claim 1, wherein the first enclosed region and the second enclosed region have different major emission peak wavelengths.

6. A lamp module, comprising:

(a) an elongated light source envelope, including (i) an inner wall and an outer wall formed around a longitudinal axis, the inner wall and the outer wall connected at a first axial end by a first side wall and a second axial end by a second side wall, the inner wall, the outer wall, the first side wall, and the second side wall defining an enclosed space internal to the envelope, the inner wall defining an inner space around the longitudinal axis, and (ii) one or more walls included between the inner wall and the outer wall to form at least a first enclosed region and a second enclosed region within the enclosed space, wherein the one or more walls extending along the longitudinal axis from the first side wall to the second side wall; and (b) an antenna inserted in the inner space.

7. The lamp module of claim 6, wherein the antenna comprises an antenna lead having a first end proximal to the inner space and a second end configured to be connected to a radio frequency (RF) or microwave energy source.

8. The lamp module of claim 7, wherein the antenna lead is an exposed inner conductor of a coaxial cable.

9. The lamp module of claim 6, wherein the first enclosed region is configured to emit a different spectrum of ultraviolet radiation from the second enclosed region in response to excitation of the first enclosed region and the second enclosed region by microwave radiation.

10. The lamp module of claim 6, wherein the first enclosed region is filled with a first fill material and the second enclosed region is filled with a second fill material different from the first fill material.

11. The lamp module of claim 10, wherein the wavelengths of light emittable by the first enclosed region and the second enclosed region are adjusted by varying a type of fill material or an amount of fill material in the first enclosed region and the second enclosed region, respectively.

12. The lamp module of claim 6, wherein the first enclosed region and the second enclosed region have different major emission peak wavelengths.

13. A lamp system, comprising:

a housing;

a radio frequency (RF) or microwave energy source located within the housing;

an antenna coupled to the RF or microwave energy source; and an elongated light source envelope radiatively coupled to the RF or microwave energy source, the elongated light source envelope including (i) an inner wall and an outer wall formed around a longitudinal axis, the inner wall and outer wall connected at a first axial end by a first side wall and a second axial end by a second side wall, the inner wall, outer wall, the first side wall, and the second side wall defining an enclosed space internal to the envelope, the inner wall defining an inner space around the longitudinal axis, and (ii) one or more walls included between the outer wall and the inner wall to form at least a first enclosed region and a second enclosed region within the enclosed space, wherein the one or more walls extending along the longitudinal axis from the first side wall to the second side wall, wherein the antenna is inserted in the inner space.

14. The lamp system of claim 13, wherein the antenna comprises an antenna lead having a first end proximal to the inner space and a second end coupled to the RF or microwave energy source.

15. The lamp system of claim 14, wherein the antenna comprises a coaxial cable coupled to the RF or microwave energy source, the antenna formed from an inner conductor of the coaxial cable, the inner conductor having an exposed section located within the inner space.

16. The lamp system of claim 13, further comprising a reflector located around the outer wall of the light source envelope.

17. The lamp system of claim 13, wherein the first enclosed region is configured to emit a different spectrum of ultraviolet radiation from the second enclosed region in response to excitation of the first enclosed region and the second enclosed region by microwave radiation emitted by the antenna.

18. The lamp system of claim 13, wherein the first enclosed region is filled with a first fill material and the second enclosed region is filled with a second fill material different from the first fill material.

19. The lamp system of claim 18, wherein the wavelengths of light emittable by the first enclosed region and the second enclosed region are adjusted by varying a type of fill material or an amount of fill material in the first enclosed region and the second enclosed region, respectively.

20. The lamp system of claim 13, wherein the first enclosed region and the second enclosed region have different major emission peak wavelengths.

* * * * *